US011572615B2

(12) United States Patent
Zhang et al.

(10) Patent No.: US 11,572,615 B2
(45) Date of Patent: Feb. 7, 2023

(54) PREPARATION METHOD OF A ZIRCONIUM-TITANIUM-BASED ALLOY EMBEDDED ALUMINIZED LAYER

(71) Applicant: Yanshan University, Qinhuangdao (CN)

(72) Inventors: Xinyu Zhang, Qinhuangdao (CN); Yize Liu, Qinhuangdao (CN); Jiaqian Qin, Qinhuangdao (CN); Riping Liu, Qinhuangdao (CN)

(73) Assignee: Yanshan University, Qinhuangdao (CN)

( * ) Notice: Subject to any disclaimer, the term of this patent is extended or adjusted under 35 U.S.C. 154(b) by 0 days.

(21) Appl. No.: 17/345,403

(22) Filed: Jun. 11, 2021

(65) Prior Publication Data

US 2021/0388478 A1 Dec. 16, 2021

(30) Foreign Application Priority Data

Jun. 15, 2020 (CN) ..... 202010541263.9

(51) Int. Cl.
*C23C 10/48* (2006.01)
*C23C 10/60* (2006.01)

(52) U.S. Cl.
CPC ..... *C23C 10/48* (2013.01); *C23C 10/60* (2013.01)

(58) Field of Classification Search
CPC ..... C23C 10/48; C23C 10/60
See application file for complete search history.

(56) References Cited

U.S. PATENT DOCUMENTS 5,562,999 A * 10/1996 Grunke ..... C23C 10/02 428/654

FOREIGN PATENT DOCUMENTS

CN 108754409 A * 11/2018 ..... C23C 10/02
CN 109576661 A * 4/2019 ..... C23C 10/44

* cited by examiner

*Primary Examiner* — Tabatha L Penny
(74) *Attorney, Agent, or Firm* — IPro, PLLC

(57) ABSTRACT

A preparation method of a zirconium-titanium-based alloy embedded aluminized layer includes putting a zirconium-titanium-based alloy and an aluminiferous penetrant into a mould from bottom to top in a sequence of a first penetrant layer, a first zirconium-titanium-based alloy, a second penetrant layer, a second zirconium-titanium-based alloy and a third penetrant layer, and compacting to obtain a mixed sample; sequentially covering a surface of a mixed sample with activated carbon powder and alkali metal halide, and then carrying out heating and cooling treatments to obtain a zirconium-titanium-based alloy embedded aluminized layer. The preparation method does not need to adopt a special heating furnace or carry out heat treatment under a vacuum condition in an actual application, which simplifies operation process and condition and is suitable for large-scale production and application due to few technical difficulties and low equipment investment cost.

5 Claims, 3 Drawing Sheets

PREPARATION METHOD OF A ZIRCONIUM-TITANIUM-BASED ALLOY EMBEDDED ALUMINIZED LAYER

TECHNICAL FIELD

The invention relates to the technical field of metal surface modification, in particular to a preparation method of a zirconium-titanium-based alloy embedded aluminized layer.

BACKGROUND

Compared with the traditional metal materials, the titanium and the titanium alloy have the material characteristics of high specific strength, large yield ratio, excellent corrosion resistance, good biocompatibility and the like, so that the titanium and the titanium alloy have wide application in the national defense industry fields of military, aerospace and the like, and are often used for manufacturing structural components of various types of airplanes, engines and missiles.

The zirconium-titanium-based alloy has the characteristics of excellent mechanical property, excellent corrosion resistance and the like, but has a large friction coefficient, is easy to generate serious adhesive abrasion and peel, cannot play a good protection role on a subsurface layer, is easy to oxidize at high temperature, greatly influences the safety and reliability of the structure of the zirconium-titanium-based alloy, and hinders further application of the zirconium-titanium-based alloy.

In recent years, many studies have been made to improve the properties of zirconium-titanium-based alloys. In the prior art, a common modification method is solid powder embedding aluminizing. The powder embedding aluminizing process usually includes the steps of high temperature heat treatment, diffusion annealing and the like under the vacuum condition after putting zirconium-titanium base alloy in a sealed crucible or a special aluminizing tank, and obtaining the zirconium-titanium-base alloy embedded aluminized layer. However, most of the powder embedding aluminizing methods have complex preparation processes, extremely high requirements on vacuum degree in the heat treatment equipment and in the heat treatment process, high preparation cost and are not suitable for industrial application.

DISCLOSURE OF INVENTION

In view of this, it is an object of the present invention to provide a preparation method of a zirconium-titanium based alloy embedded aluminized layer. The preparation method provided by the present invention is simple, does not need to carry out heat treatment in a sealed or specially-made heating furnace, has low requirement on the vacuum degree in the heat treatment, and is suitable for large-scale production.

In order to achieve the above object, the present invention provides the following technical solutions:

The present invention provides a preparation method of a zirconium-titanium-based alloy embedded aluminized layer, comprising the following steps:

putting a zirconium-titanium-based alloy and an aluminiferous penetrant into a mould from bottom to top in the sequence of a first penetrant layer, a first zirconium-titanium-based alloy, a second penetrant layer, a second zirconium-titanium-based alloy and a third penetrant layer, and compacting to obtain a mixed sample;

sequentially covering the surface of the mixed sample with activated carbon powder and alkali metal halide, and then sequentially carrying out heat treatment and cooling to obtain a zirconium-titanium-based alloy embedded aluminized layer;

the mass ratio of the activated carbon powder to the alkali metal halide is 1-3:4-6;

the temperature of the heat treatment is 800-1200° C., and the heat preservation time is 3-5 h;

the heating rate from room temperature to the temperature of the heat treatment is 8-10° C./min;

the cooling rate of the cooling is 1-3° C./min;

the mass ratio of the first penetrant layer to the second penetrant layer to the third penetrant layer is 1-4: 2-8:1-4;

the alkali metal halide includes one or more of sodium chloride, potassium chloride, sodium bromide, and potassium bromide.

Preferably, the particle size of the activated carbon powder is 100 to 400 mesh.

Preferably, the first penetrant layer, the second penetrant layer and the third penetrant layer independently comprise raw materials of the following components:

Al powder, $Al_2O_3$ powder, $CeO_2$, and $NH_4Cl$;

the mass ratio of the Al powder to the $Al_2O_3$ powder to the $CeO_2$ to the $NH_4Cl$ is 10-45: 50-85:4:1.

Preferably, the Al powder and the $Al_2O_3$ powder independently have a particle size of 1-10 μm.

Preferably, the first zirconium-titanium-based alloy and the second zirconium-titanium-based alloy independently have a size of 5 mm×5 mm×1 mm-30 mm×30 mm×5 mm.

The present invention also provides a zirconium-titanium-based alloy embedded aluminized layer prepared by the preparation method described in the above technical solution, wherein the thickness of the aluminized layer in the zirconium-titanium-based alloy embedded aluminized layer is 85-140 μm.

The preparation method provided by the present invention comprises the following steps: putting a zirconium-titanium-based alloy and an aluminiferous penetrant into a mould from bottom to top in the sequence of a first penetrant layer, a first zirconium-titanium-based alloy, a second penetrant layer, a second zirconium-titanium-based alloy and a third penetrant layer, and compacting to obtain a mixed sample; sequentially covering the surface of the mixed sample with activated carbon powder and alkali metal halide, and then sequentially carrying out heat treatment and cooling to obtain a zirconium-titanium-based alloy embedded aluminized layer; the mass ratio of the activated carbon powder to the alkali metal halide is 1-3: 4-6; the temperature of the heat treatment is 800-1200° C., and the heat preservation time is 3-5 h; the heating rate from room temperature to the temperature of the heat treatment is 8-10° C./min; the cooling rate of the cooling is 1-3° C./min; the mass ratio of the first penetrant layer to the second penetrant layer to the third penetrant layer is 1-4: 2-8:1-4; the alkali metal halide includes one or more of sodium chloride, potassium chloride, sodium bromide, and potassium bromide.

The method adopts the sequence of a first penetrant layer, a first zirconium-titanium-based alloy, a second penetrant layer, a second zirconium-titanium-based alloy and a third penetrant layer to be placed in a mould, so as to ensure that the surface of the zirconium-titanium-based alloy is uniformly coated with the aluminiferous penetrant; the surface of the compacted mixed sample is sequentially covered with activated carbon powder and alkali metal halide, and the alkali metal halide can be melted into liquid in the high-temperature heat treatment process, so that the effect of sealing and isolating air is achieved, and a sealed environment is provided for the heat treatment process; the activated carbon powder can isolate alkali metal halide, prevent liquid alkali metal halide from entering a mould to pollute an aluminiferous penetrant in the heat treatment process, and can further improve the sealing degree. In the practical application process, the preparation method provided by the present invention does not need to adopt a sealed or specially-made heating furnace, can adopt any heating furnace, does not need to consider the vacuum degree in the heat treatment process, simplifies the operation process and the operation conditions, has small technical difficulty and less equipment investment, and is suitable for large-scale production and application.

DETAILED DESCRIPTION

Figure 1:
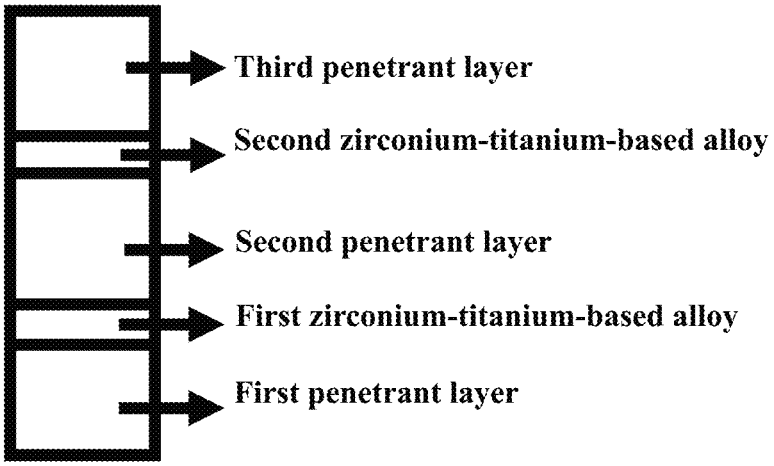
FIG. 1 is a cross-sectional profile of a graphite mould according to the present invention after loading a sample.

The present invention provides a preparation method of a zirconium-titanium-based alloy embedded aluminized layer, comprising the following steps:

putting a zirconium-titanium-based alloy and an aluminiferous penetrant into a mould in the sequence of a first penetrant layer, a first zirconium-titanium-based alloy, a second penetrant layer, a second zirconium-titanium-based alloy and a third penetrant layer, and compacting to obtain a mixed sample;

sequentially covering the surface of the mixed sample with activated carbon powder and alkali metal halide, and then sequentially carrying out heat treatment and cooling to obtain a zirconium-titanium-based alloy embedded aluminized layer.

In the present invention, the raw materials are all commercial products which are conventional in the art, unless otherwise specified.

The present invention puts the zirconium-titanium-based alloy and the aluminiferous penetrant into the mould from bottom to top in the sequence of the first penetrant layer, the first zirconium-titanium-based alloy, the second penetrant layer, the second zirconium-titanium-based alloy and the third penetrant layer, and compacts to obtain the mixed sample;

The composition of the zirconium-titanium-based alloy is not particularly limited in the present invention, and the conventional zirconium-titanium-based alloy in the art can be adopted. The mass ratio of the zirconium element to the titanium element in the zirconium-titanium alloy is not particularly limited in the present invention, and the conventional zirconium-titanium alloy in the art can be adopted. The sizes of the first zirconium-titanium-based alloy and the second zirconium-titanium-based alloy in the present invention are preferably 5 mm×5 mm×1 mm-30 mm×30 mm×5 mm independently.

According to the present invention, the zirconium-titanium-based alloy is preferably sequentially ground, polished and cleaned, and then is mixed with an aluminiferous penetrant. The present invention does not specifically limit the operation of the grinding and polishing, and the grinding and polishing methods known to those skilled in the art can be used. In the present invention, the cleaning mode is preferably alcohol ultrasonic, and the alcohol ultrasonic time is preferably 20-30 min. The concentration of the alcohol and the power of the ultrasonic wave are not specially limited, as long as the zirconium-titanium-based alloy can be cleaned after polishing.

In the present invention, the first penetrant layer, the second penetrant layer and the third penetrant layer independently preferably comprise the following raw materials: Al powder, $Al_2O_3$ powder, $CeO_2$ and $NH_4Cl$. In the present invention, the mass ratio of the Al powder, $Al_2O_3$ powder, $CeO_2$ and $NH_4Cl$ is preferably 10-45:50-85:4:1, and more preferably 15-35:60-80:4:1. In the present invention, the particle diameters of the Al powder and the $Al_2O_3$ powder are independently preferably 1-15 μm, and more preferably 3-12 μm.

The preparation method of the aluminiferous penetrant is not specially limited in the present invention, the aluminiferous penetrant is prepared by adopting a mixing mode known by a person skilled in the art, the grinding is preferred in the embodiment of the present invention, the grinding time is preferably 50-60 min, the rotation speed of the grinding is not specially limited, as long as it can ensure that the aluminiferous penetrant can be uniformly mixed.

In the present invention, the mass ratio of the first penetrant layer to the second penetrant layer to the third penetrant layer is 1-4: 2-8:1-4, preferably 1.5-3.5:3.5-7.5: 1.5-3.5. In the present invention, the dosage of the first penetrant layer, the second penetrant layer and the third penetrant layer can ensure the effect of aluminizing, so that the prepared aluminized layer is thicker and has good uniformity, the cracks of the penetrant layer are effectively reduced, and the thickness of the zirconium-titanium based alloy embedded aluminized layer is improved; the present invention adopts the sequence of the first penetrant layer, the first zirconium-titanium-based alloy, the second penetrant layer, the second zirconium-titanium-based alloy and the third penetrant layer to be arranged in the mould, thereby ensuring that the aluminiferous penetrant is uniformly coated on the surface of the zirconium-titanium-based alloy, so that the prepared aluminized layer is thicker and has good uniformity and effectively reduces the cracks of the penetrant layer.

In the present invention, the material of the mould is preferably graphite. The size of the mould is not specially limited in the present invention, as long as the size of the mould can be matched with the size of the zirconium-titanium-based alloy. The graphite mould in the embodiment of the present invention preferably has a diameter of 20 mm. According to the invention, after a layer of graphite paper is preferably laid in the graphite mould, the zirconium-titanium-based alloy and the aluminiferous penetrant are filled in the graphite mould according to the sequence described in the above technical solution.

FIG. 1 is a cross-sectional view of a graphite mould after a sample is loaded therein according to the present invention, in which a zirconium-titanium alloy and an aluminiferous penetrant are placed in the mould in the order of a first penetrant layer, a first zirconium-titanium alloy, a second penetrant layer, a second zirconium-titanium alloy, and a third penetrant layer from bottom to top.

In the present invention, the compaction is preferably carried out in a hydraulic press, the head of which is preferably a standard head. According to the present invention, preferably, after graphite paper is laid on the surface of the pressure head, the compaction is performed by hydraulic press. The hydraulic press is not particularly limited by the present invention, and a hydraulic press known to those skilled in the art may be used. The present invention preferably carries out hydraulic press compaction once after each time of filling the aluminiferous penetrant. In the present invention, the degree of compaction is preferably until the pressing rod of the hydraulic press can not be pressed. The sample is compacted by the hydraulic press, so that the compaction degree of the sample is good, less aluminiferous penetrant flies out in the compaction process, the loss of the sample is reduced, and the thickness of the zirconium-titanium-based alloy embedded aluminized layer is increased. In addition, the zirconium-titanium-based alloy and the aluminiferous penetrant are compacted by the hydraulic press, so that the contact area between aluminum particles in the aluminiferous penetrant and the surface of the zirconium-titanium-based alloy can be increased, aluminum steam generated in the heat treatment process can be promoted to better penetrate into the zirconium-titanium-based alloy, and the utilization rate of aluminum is improved.

After a mixed sample is obtained, the surface of the mixed sample is sequentially covered with activated carbon powder and alkali metal halide, and then is sequentially subjected to heat treatment and cooling to obtain the zirconium-titanium-based alloy embedded aluminized layer.

In the present invention, preferably, after the mixed sample is loaded into a crucible, the surface of the mixed sample is sequentially covered with activated carbon powder and alkali metal halide.

In the present invention, the alkali metal halide includes one or more of sodium chloride, potassium chloride, sodium bromide and potassium bromide, and sodium chloride is further preferable in the embodiment of the present invention. The melting point of the alkali metal halide adopted by the invention is 734-801° C., so that the alkali metal halide can be melted into liquid in the high-temperature heat treatment process, and can be prevented from being dissolved in advance in the temperature rise process to cause unnecessary loss. In the present invention, the mass ratio of the activated carbon powder to the alkali metal halide is 1-3:4-6, preferably 1.5-2.5:4.5-5.5; the particle size of the activated carbon powder is preferably 100-400 meshes. In the present invention, the activated carbon powder can isolate alkali metal halide, prevent liquid alkali metal halide from entering a mould to pollute an aluminiferous penetrant in the heat treatment process and further improve the sealing effect; the alkali metal halide can be melted into liquid in the high-temperature heat treatment process, the effect of sealing and isolating air is achieved, a sealed environment is provided for the heat treatment process, and in the practical application process, a sealed or specially-made heating furnace is not needed, and the vacuum degree in the heat treatment process is not needed to be considered.

In the present invention, the temperature of the heat treatment is 800-1200° C., and preferably 900-1100° C.; the heat preservation time of the heat treatment is 3-5 h; the heating rate from room temperature to the temperature of the heat treatment is 8-10° C./min, preferably 8.5-9.5° C./min. In the present invention, the change of the heat treatment condition can affect the aluminizing process, so that the aluminized layer becomes thinner or the surface of the aluminized layer is easy to peel off, and if the temperature is too high or the temperature rise rate is too high, the thermal stress is larger and a large amount of cracks are generated; if the temperature is too low, the diffusion of aluminum is not complete and the thickness of the penetrant layer is not ideal. The heat treatment equipment is not particularly limited in the present invention, any heat treatment equipment can be adopted, and the muffle furnace is preferably adopted in the embodiment of the invention, so that the vacuum degree does not need to be additionally controlled.

In the present invention, the temperature reduction rate of the cooling is 1-3° C./min, preferably 1.5-2.5° C./min. In the present invention, if the temperature reduction rate is too high, it will lead to cracks in the zirconium-titanium-based alloy embedded aluminized layer.

The invention also provides the zirconium-titanium-based alloy embedded aluminized layer prepared by the preparation method of the above technical solution, and the thickness of the aluminized layer in the zirconium-titanium-based alloy embedded aluminized layer is 85-140 μm.

The method for preparing the zirconium-titanium-based alloy embedded aluminized layer according to the present invention will be described in detail with reference to the following examples, which should not be construed as limiting the scope of the present invention.

Example 1

Uniformly mixing 2.25 g (with the particle size of 10 μm) of Al powder, 12 g (with the particle size of 10 μm) of $Al_2O_3$ powder, 0.6 g of ammonium chloride and $CeO_2$ 0.15 g by using a grinding mortar, and grinding for 60 min to obtain an aluminiferous penetrant;

grinding and polishing two zirconium-titanium alloys by using abrasive paper, and ultrasonically cleaning the two zirconium-titanium alloys for 30 min by using alcohol for later use;

taking a graphite mould with the diameter of 20 mm, respectively filling a layer of graphite paper on the graphite mould and a hydraulic press pressure head, putting 3 g of the aluminiferous penetrant which is uniformly mixed into the mould, compacting by using a hydraulic press, putting a zirconium-titanium alloy, then adding 6 g of the aluminiferous penetrant, compacting by using the hydraulic press, putting the other zirconium-titanium alloy, then adding 3 g of the aluminiferous penetrant, and compacting by using the hydraulic press to obtain a mixed sample;

vertically placing the obtained mixed sample into the center of a crucible, pouring activated carbon powder until the mixed sample is completely covered, then pouring sodium chloride, wherein the mass ratio of the activated carbon powder to the sodium chloride is 2:5, covering the crucible with a cover, placing the crucible into a muffle furnace, heating from room temperature to 1000° C. at the heating rate of 10° C./min, preserving heat for 4 hours, cooling from 1000° C. to room temperature at the cooling rate of 1° C./min after finishing heat preservation, and taking out the zirconium-titanium alloy matrix in the graphite mould by using a hydraulic press after taking out the crucible, thus obtaining the zirconium-titanium-based alloy embedded aluminized layer with the thickness of 90 μm.

Example 2

This example is prepared under the same conditions as in example 1 except that the aluminiferous penetrant raw materials was used in amounts of 3.75 g (10 μm in particle size) of Al powder, 10.5 g (10 μm in particle size) of $Al_2O_3$ powder, 0.6 g of ammonium chloride and $CeO_2$ 0.15 g, and the materials were mixed uniformly in a grinding mortar for 60 min to obtain the aluminiferous penetrant.

Figure 2:
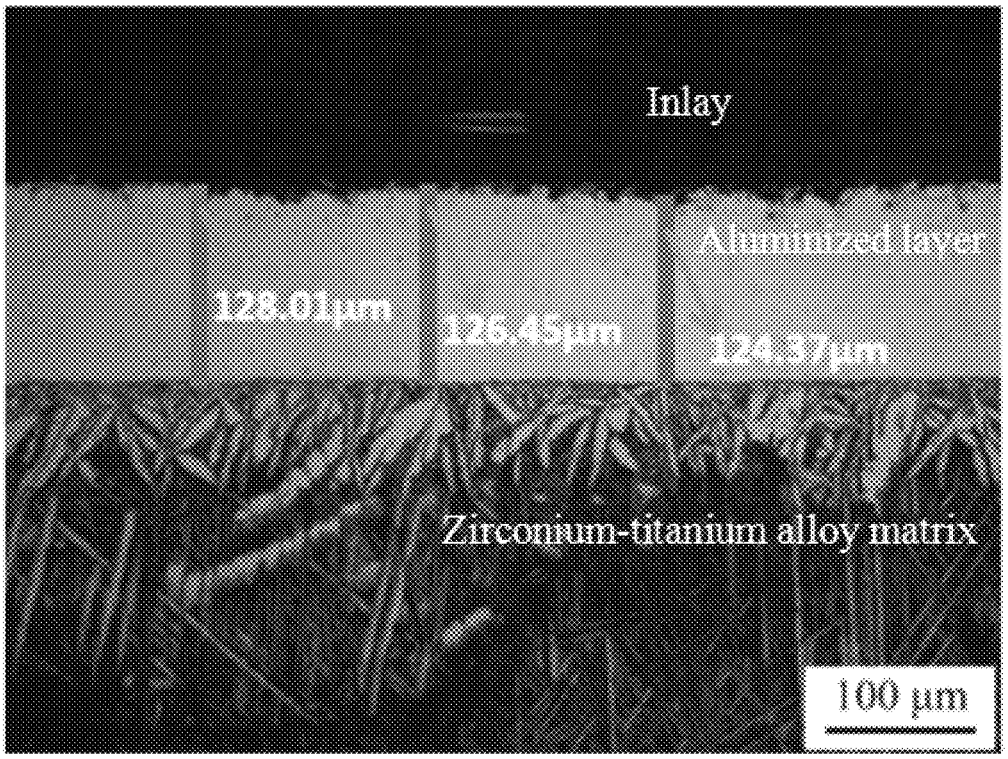
FIG. 2 is a cross-sectional metallograph of a zirconium-titanium-based alloy embedded aluminized layer obtained in example 2.

FIG. 2 is a cross-sectional metallograph of the zirconium-titanium-based alloy embedded aluminized layer prepared in example 2, and it can be seen from the diagram that the prepared zirconium-titanium-based alloy embedded aluminized layer has uniform thickness, obvious boundary with the zirconium-titanium alloy, thickness of 125 μm, compactness and no obvious through crack, and the inlay material in the diagram is a conventional inlay material in the art.

Figure 3:
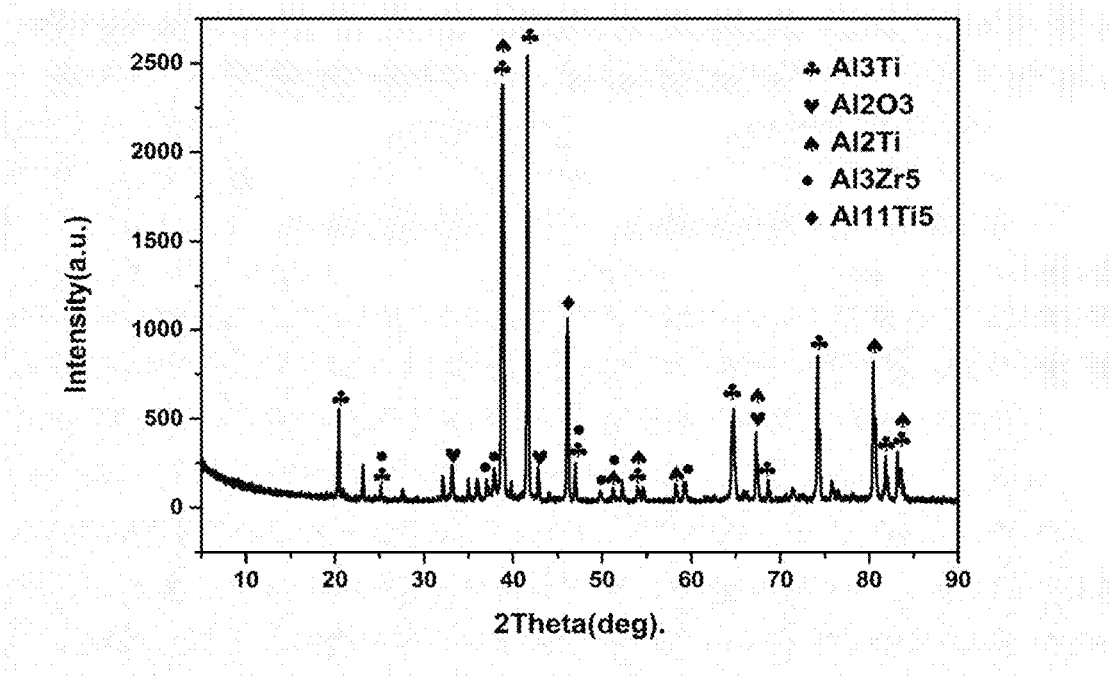
FIG. 3 is an XRD pattern of a zirconium-titanium-based alloy embedded aluminized layer obtained in example 2.

FIG. 3 is an XRD pattern of the zirconium-titanium-based alloy embedded aluminized layer prepared in example 2, which shows that the zirconium-titanium-based alloy embedded aluminized layer mainly consists of $Al_3Ti$ and $Al_2Ti$, and has a small amount of $Al_3Zr_5$ phase and very little $Al_2O_3$, thereby illustrating that the sealing of the preparation method provided by the present invention is good.

Example 3

This example is prepared under the same conditions as in example 1 except that the aluminiferous penetrant raw materials were used in an amount of 5.25 g (10 μm in particle size) of Al powder, 9 g (10 μm in particle size) of $Al_2O_3$ powder, 0.6 g of ammonium chloride and 0.15 g of $CeO_2$, and the mixture was mixed in a grinding mortar to obtain an aluminiferous penetrant.

The zirconium-titanium-based alloy embedded aluminized layer is obtained, and the thickness of the aluminized layer is 135 μm.

Example 4

This example is prepared under the same conditions as example 1, except that the first aluminiferous penetrant is used in an amount of 2 g, the second aluminiferous penetrant is used in an amount of 5 g, and the third aluminiferous penetrant is used in an amount of 2 g when the zirconium-titanium alloy and the aluminiferous penetrant are mixed.

The zirconium-titanium-based alloy embedded aluminized layer is obtained, and the thickness of the aluminized layer is 88 μm.

Example 5

This example is prepared under the same conditions as example 2, except that the first aluminiferous penetrant is used in an amount of 3 g, the second aluminiferous penetrant is used in an amount of 6 g, and the third aluminiferous penetrant is used in an amount of 3 g when the zirconium-titanium alloy and the aluminiferous penetrant are mixed.

The zirconium-titanium-based alloy embedded aluminized layer is obtained, and the thickness of the aluminized layer is 125 μm.

Example 6

This example is prepared under the same conditions as example 2, except that during the heat treatment, the temperature is raised from room temperature to 1100° C. at a heating rate of 10° C./min, the temperature is preserved for 4 h, and after finishing heat preservation, the temperature is lowered from 1100° C. to room temperature at a cooling rate of 1° C./min.

The zirconium-titanium-based alloy embedded aluminized layer is obtained, and the thickness of the aluminized layer is 136 μm.

Example 7

This example is prepared under the same conditions as example 2, except that during the heat treatment, the temperature is raised from room temperature to 900° C. at a heating rate of 8° C./min, the temperature is preserved for 4 h, and after finishing heat preservation, the temperature is lowered from 900° C. to room temperature at a cooling rate of 3° C./min.

The zirconium-titanium-based alloy embedded aluminized layer is obtained, and the thickness of the aluminized layer is 90 μm.

Comparative Example 1

Uniformly mixing 3.75 g of Al powder (10 μm in particle size), 10.5 g of $Al_2O_3$ powder (10 μm in particle size), 0.6 g of ammonium chloride and $CeO_2$ 0.15 g by using a grinding mortar to obtain an aluminiferous penetrant;

grinding and polishing the two zirconium-titanium alloys by using abrasive paper, and ultrasonically cleaning the two zirconium-titanium alloys for 30 min by using alcohol for later use;

taking a graphite mould with the diameter of 20 mm, respectively filling a layer of graphite paper on the graphite mould and a hydraulic press pressure head, putting 3 g of the aluminiferous penetrant which is uniformly mixed, compacting by using a hydraulic press, adding one zirconium-titanium alloy, then adding 6 g of the aluminiferous penetrant, compacting by using the hydraulic press, putting the other zirconium-titanium alloy, then adding 3 g of the aluminiferous penetrant, and compacting by using the hydraulic press to obtain a mixed sample;

the obtained mixed sample is put into a vacuum tube furnace, and the vacuum degree is −0.1 Mpa. And heating to 1000° C. from room temperature at the heating rate of 10° C./min, preserving heat for 4 h, cooling to room temperature from 1000° C. at the cooling rate of 1° C./min after the heat preservation is finished, after taking out, the zirconium-titanium alloy matrix in the graphite mould is took out by using a hydraulic press, and obtaining the zirconium-titanium-based alloy embedded aluminized layer with the aluminized layer thickness of 81 μm.

Figure 4:
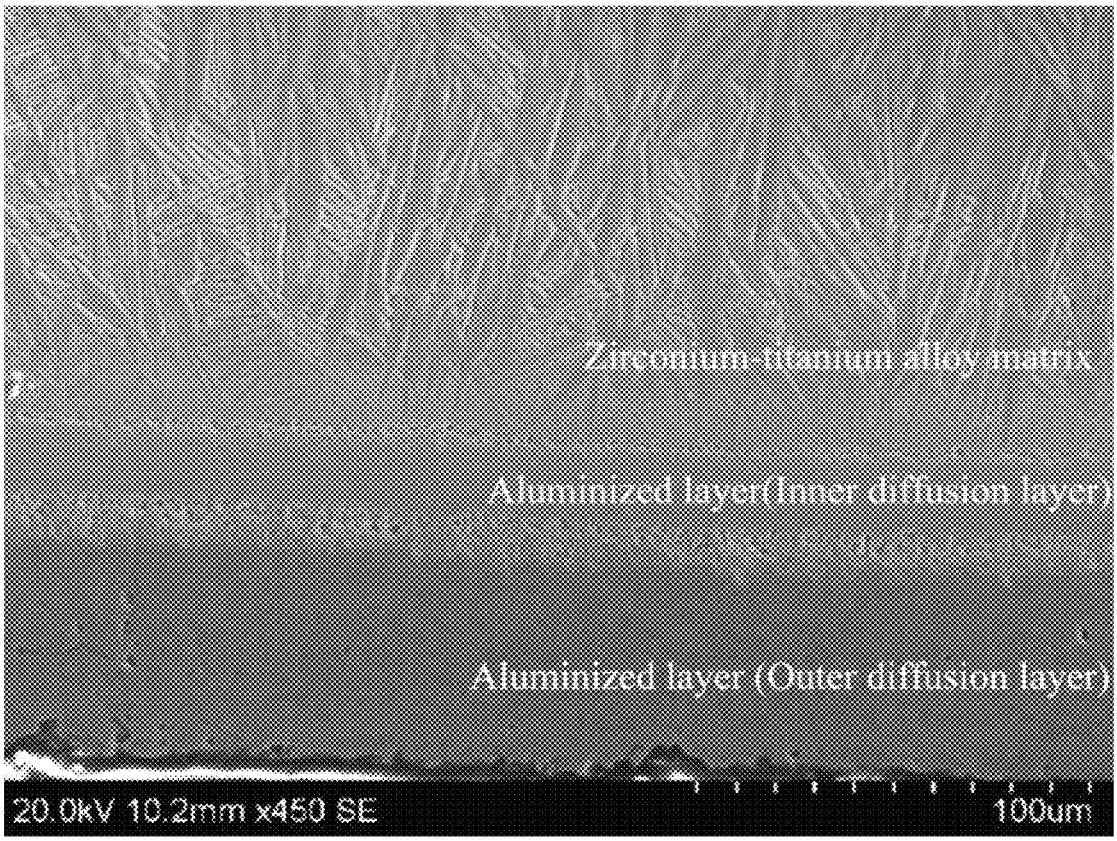
FIG. 4 is a cross-sectional metallograph of a zirconium-titanium-based alloy embedded aluminized layer prepared in comparative example 1.

FIG. 4 is a cross-sectional metallograph of the zirconium-titanium-based alloy embedded aluminized layer obtained in comparative example 1, wherein L1 is 55 μm, L2 is 17 μm, L3 is 64 μm, the total penetrant layer thickness is 81 μm, the diffusion layer can be divided into an inner diffusion layer L2 and an outer diffusion layer L3, the inner diffusion layer is relatively dense, and cracks and pores exist in the outer diffusion layer.

Comparing the results of example 2 and comparative example 1, it can be seen that the surface of the mixed sample of comparative example 1, which is not covered with the activated carbon powder and sodium chloride, was heat-treated in a vacuum tube furnace to obtain an aluminized layer having a thickness of 81 μm and cracks and holes in the outer diffusion layer, while the aluminized layer of example 2 having a thickness of 125 μm, which was dense and had no significant through-cracks. The invention shows that the surface of the mixed sample is sequentially covered with the activated carbon powder and the sodium chloride, so that a good vacuum environment can be provided for the mixed sample in the heat treatment process, heating equipment and vacuum degree do not need to be considered in the heat treatment process of the zirconium-titanium-based alloy embedded aluminized layer, the thickness of the zirconium-titanium-based alloy embedded aluminized layer and the uniformity of the penetrant layer are improved, and cracks of the penetrant layer are effectively reduced.

Comparative Example 2

This comparative example is different from example 1 in that the surface of the mixed sample is directly coated with sodium chloride and not coated with the activated carbon powder.

The zirconium-titanium-based alloy embedded aluminized layer is prepared, and the thickness of the aluminized layer is 40 μm.

Figure 5:
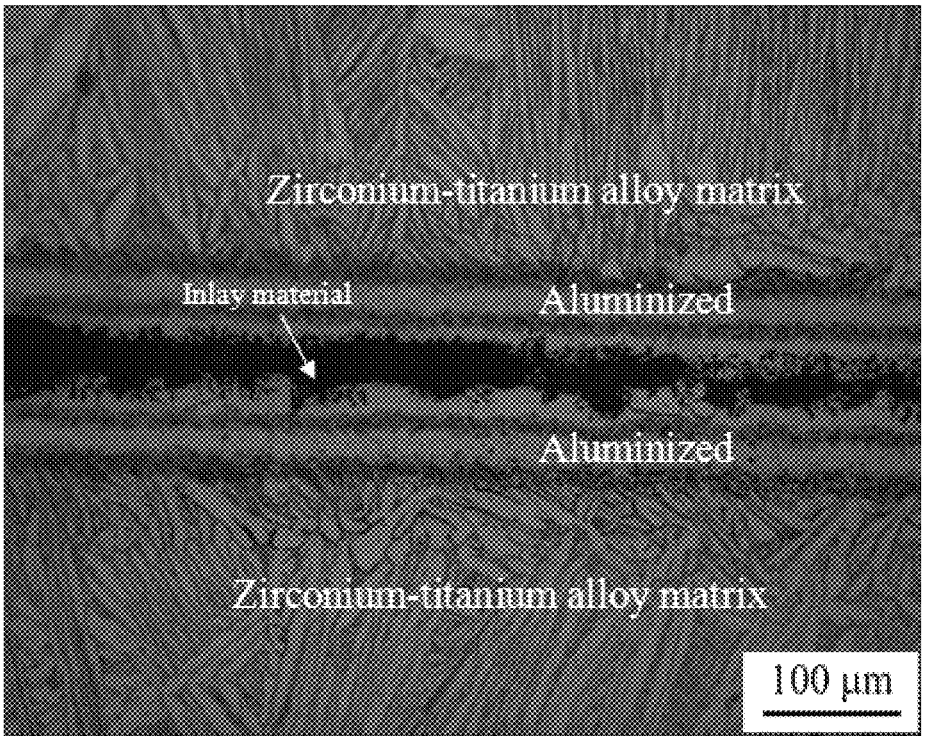
FIG. 5 is a cross-sectional metallograph of a zirconium-titanium-based alloy embedded aluminized layer obtained in comparative example 2.

FIG. 5 is a cross-sectional metallograph of the zirconium-titanium-based alloy embedded aluminized layer prepared in comparative example 2, and it can be seen that the prepared zirconium-titanium-based alloy embedded aluminized layer is uneven and thin, and the inlay material in the diagram is a conventional inlay material in the art.

Comparing the results of example 1 and comparative example 2, it is understood that in comparative example 2, the surface of the mixed sample was not covered with the activated carbon powder, but was directly covered with sodium chloride, and heat-treated in a muffle furnace to give an aluminized layer having a thickness of 40 μm, but the absence of the activated carbon powder covering caused a small amount of sodium chloride to enter the grinding tool when the sodium chloride was melted into a liquid at a high temperature, and thus sufficient aluminizing could not be performed.

Comparative Example 3

Figure 6:
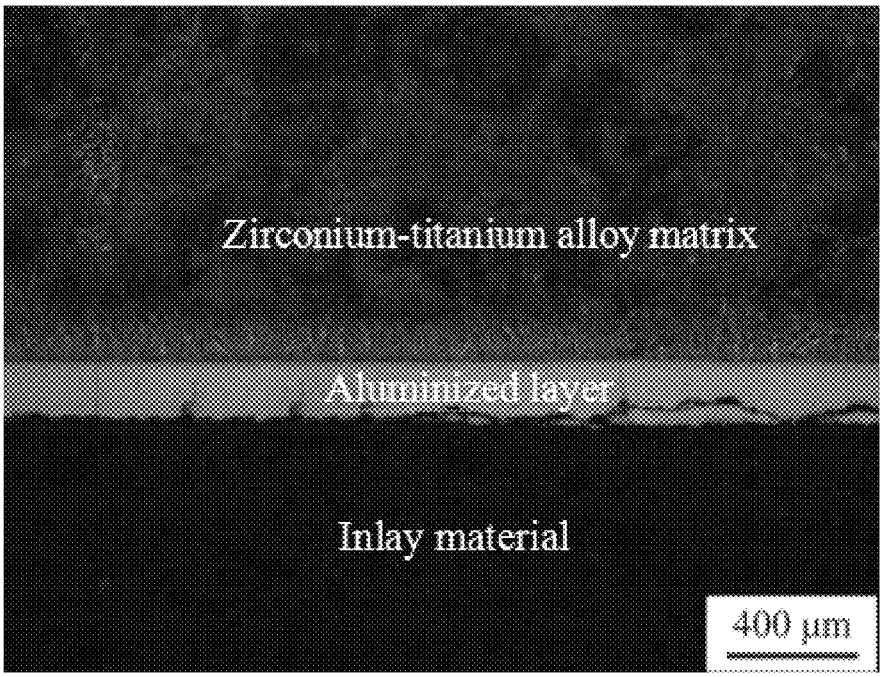
FIG. 6 is a cross-sectional metallograph of a zirconium-titanium-based alloy embedded aluminized layer obtained in comparative example 3.

Comparative example 3 is different from example 2 in that the cooling rate is not controlled and the temperature is naturally decreased. FIG. 6 is a cross-sectional metallograph of the zirconium-titanium-based alloy embedded aluminized layer obtained in comparative example 3, the thickness of the aluminized layer is 120 μm, but a large number of significant cracks were observed and the penetrant layer was not uniform, and the inlay material in the diagram is a conventional inlay material in the art.

The above description is merely a preferred embodiment of the present invention, and it should be pointed out that, for a person of ordinary skill in the art, several improvements and modifications can be made without departing from the principle of the present invention, and these improvements and modifications should also be regarded as the scope of protection of the present invention.

What is claimed is:

1. A preparation method of a zirconium-titanium-based alloy embedded aluminized layer, comprising the following steps:

putting a zirconium-titanium-based alloy and an aluminiferous penetrant into a mould from bottom to top in a sequence of a first penetrant layer, a first zirconium-titanium-based alloy, a second penetrant layer, a second zirconium-titanium-based alloy and a third penetrant layer, and compacting to obtain a mixed sample;

sequentially covering a surface of the mixed sample with activated carbon powder and alkali metal halide, and then sequentially carrying out heat treatment and cooling to obtain a zirconium-titanium-based alloy embedded aluminized layer;

the mass ratio of the activated carbon powder to the alkali metal halide is 1-3:4-6;

the temperature of the heat treatment is 800-1200° C., and the heat treatment time is 3-5 h;

a heating rate from room temperature to the temperature of the heat treatment is 8-10° C./min;

a cooling rate of the cooling is 1-3° C./min;

the mass ratio of the first penetrant layer to the second penetrant layer to the third penetrant layer is 1-4:2-8:1-4;

the alkali metal halide includes one or more of sodium chloride, potassium chloride, sodium bromide, and potassium bromide.

2. The preparation method according to claim 1, wherein the particle size of the activated carbon powder is 100 to 400 mesh.

3. The preparation method according to claim 1, wherein the first penetrant layer, the second penetrant layer and the third penetrant layer independently comprise raw materials of the following components:

Al powder, $Al_2O_3$ powder, $CeO_2$, and $NH_4Cl$;

the mass ratio of the Al powder to the $Al_2O_3$ powder to the $CeO_2$ to the $NH_4Cl$ is 10-45:50-85:4:1.

4. The preparation method according to claim 3, wherein the Al powder and the $Al_2O_3$ powder independently have a particle size of 1-10 μm.

5. The preparation method according to claim 1, wherein the first zirconium-titanium-based alloy and the second zirconium-titanium-based alloy independently have a size of 5 mm×5 mm×1 mm-30 mm×30 mm×5 mm.

* * * * *